US005239730A

United States Patent [19]

Grass

[11] Patent Number: 5,239,730

[45] Date of Patent: Aug. 31, 1993

[54] HINGE WITH ROTARY CUP

[75] Inventor: Alfred Grass, Höchst/Vlbg., Austria

[73] Assignee: Grass AG, Höchst/Vlbg., Austria

[21] Appl. No.: 902,912

[22] Filed: Jun. 23, 1992

[30] Foreign Application Priority Data

Jun. 26, 1991 [DE] Fed. Rep. of Germany ... 9107834[U]
Aug. 9, 1991 [DE] Fed. Rep. of Germany ... 9109862[U]

[51] Int. Cl.[5] ..... E05D 7/12; E05D 5/00

[52] U.S. Cl. ..... 16/272; 16/382; 16/384

[58] Field of Search ..... 16/272, 257, 254, DIG. 43, 16/382, 383, 384

[56] References Cited

FOREIGN PATENT DOCUMENTS 2150409 4/1973 Fed. Rep. of Germany ..... 16/384
2334246 1/1975 Fed. Rep. of Germany ..... 16/384
2206986 7/1975 Fed. Rep. of Germany ..... 16/384
3722950 1/1989 Fed. Rep. of Germany ..... 16/382
1499689 10/1967 France ..... 16/384
1381965 1/1975 United Kingdom ..... 16/382

*Primary Examiner*—John Sipos
*Assistant Examiner*—Carmine Cuda

[57] ABSTRACT

Described is a hinge with a rotary cup and a press-fit cup at the end of the hinge-joint, in which for assembly the rotary cup is inserted into the press-fit cup on the door side and for fastening is twisted in a bayonet-like manner. In order to prevent damage by parts projecting at the top, the press-fit cup is provided with lateral walls of reduced height in such a way that the press-fit cup is completely countersunk in the cup drilling on the door side and that from the bottom of the press-fit cup rise up bent portions which, through turning, are engaged by lugs of the rotary cup.

4 Claims, 3 Drawing Sheets

HINGE WITH ROTARY CUP

Figures 1, 2:
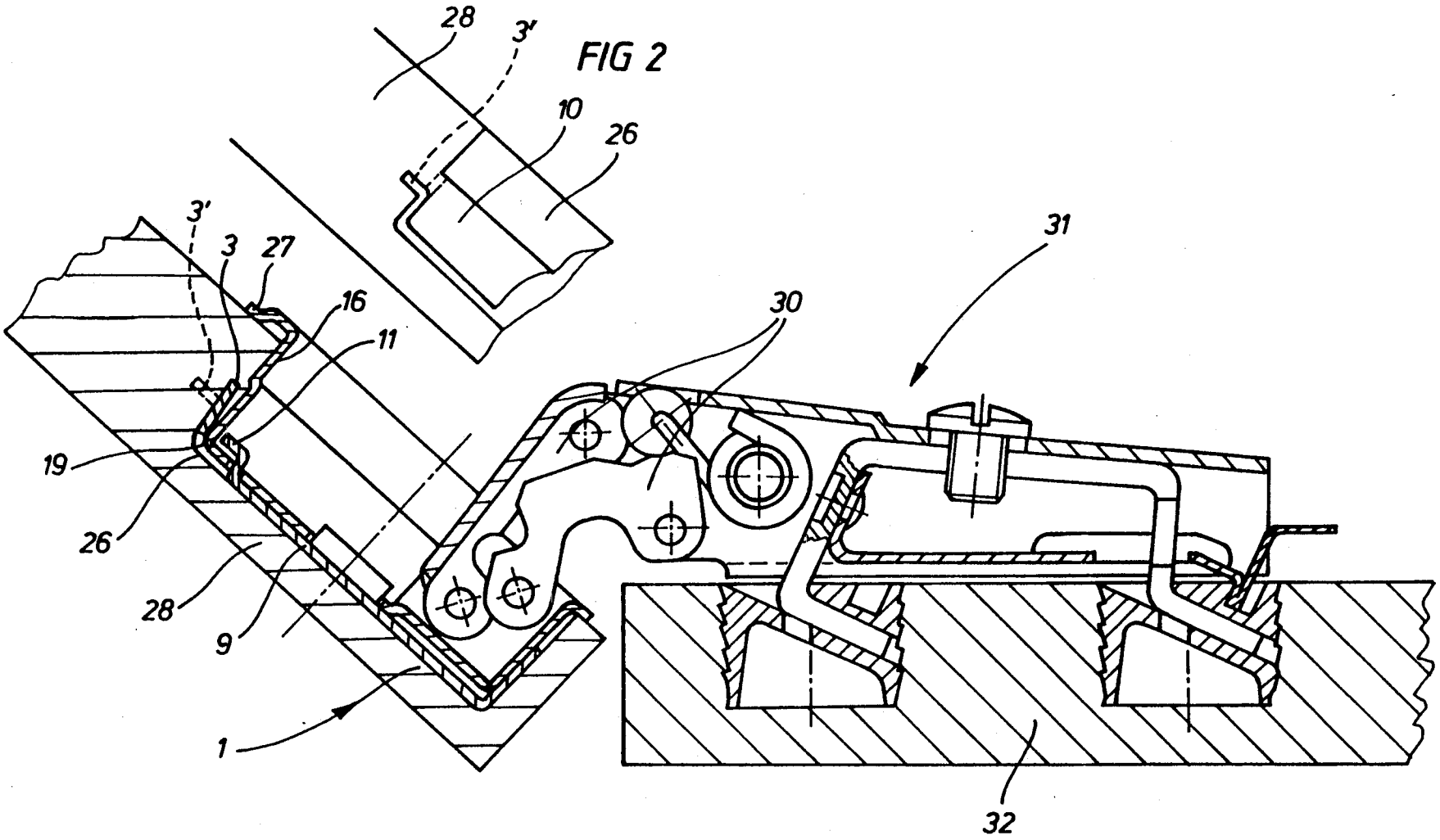

The innovation concerns a hinge with rotary cup and a press-fit cup at the end of the hinge joint, in which for assembly the rotary cup is inserted into the press-fit cup on the door side and for fastening is twisted in bayonet-like fashion.

A hinge with rotary cup such as this is already known, in which by pivoting the hinge joint the rotary cup at the end of the hinge joint is twisted into an fastening on the door side.

However, the disadvantage with the known hinge is that the fastening on the door side, into which the rotary cup is twisted, still substantially projects over the cup drilling of the door, so that parts still project from the cup drilling on the door side.

It is important, however, that furniture parts which are to be provided with a hinge do not have projecting parts in individual furniture parts, especially during transportation, as this could result in damage when the furniture parts are stacked tightly on top of each other.

It is therefore the object of the present innovation to further develop a hinge with rotary cup of the aforementioned type in such a way that no projecting parts exist in the region of the cup drilling on the door side.

This object is achieved in that the press-fit cup has laterally rising walls of reduced height, in such a way that the press-fit cup is completely countersunk in the cup drilling on the door side, and that bent portions project from the bottom surface of the press-fit cup which on turning are engaged by corresponding lugs of the rotary cup.

The core of the innovation essentially resides in the fact that the press-fit cup is completely countersunk in the cup drilling on the door side so that no parts of the hinge cup at all project beyond the drilling itself.

The transportation of the furniture parts can now proceed completely without problems, as the furniture parts in tight packages can now be stacked on top to each other without damage being possible by projecting parts.

During assembly of the furniture parts the rotary cup of the hinge joint is inserted into the press-fit cup on the door side and twisted so as to achieve a bayonet-like fastening of the hinge joint, or the rotary cup engages with its lugs in a bayonet-like manner the projecting bent portions of the press-fit cup.

In a preferred embodiment the press-fit cup has press-fit indentations in the edge region.

It is furthermore advantageous if the rotary cup has an external flange which rests on the edge of the cup drilling on the door side.

For ease of assembly during the bayonet-like twisting, the lugs of the rotary cup are at a slight tilt.

The subject of the invention of the present innovation is provided not only by the subject of the individual protective claims, but also by a combination of the individual protective claims together.

All the details and features disclosed in the documents — including the abstract — especially the spacial embodiment shown in the drawings, are claimed as essential to the invention in so far as they are novel with respect to the state of the art, either individually or in combination.

The innovation is now explained in more detail with the aid of the drawings representing only one embodiment example. Further essential features and advantages of the innovation become obvious from the drawings and their description.

Figure 3:
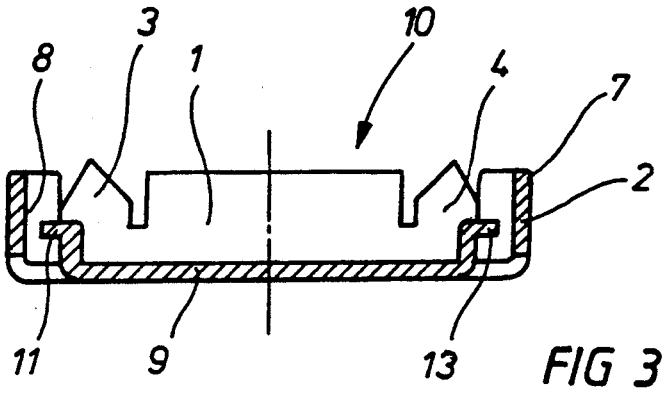
Figure 4:
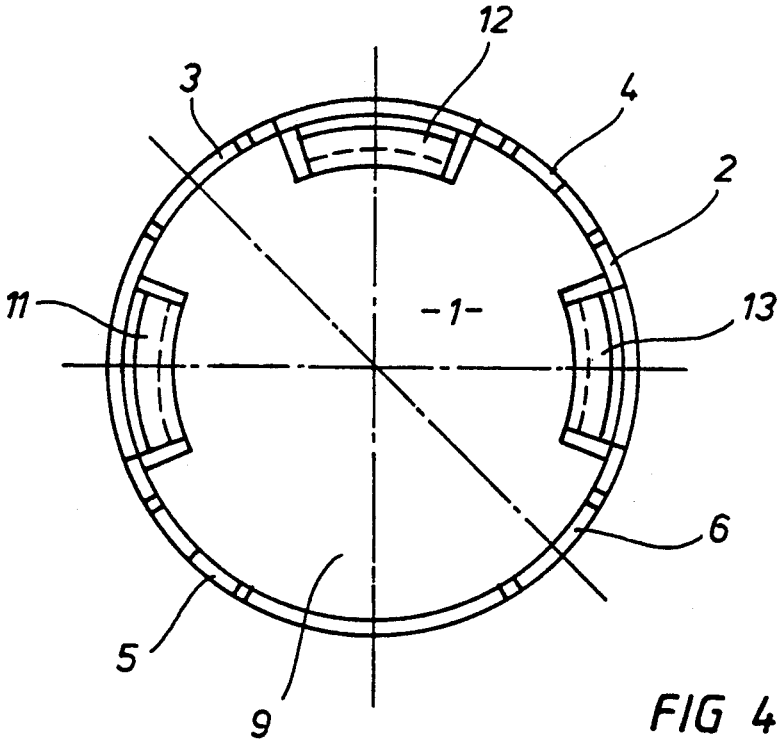
Figure 6:
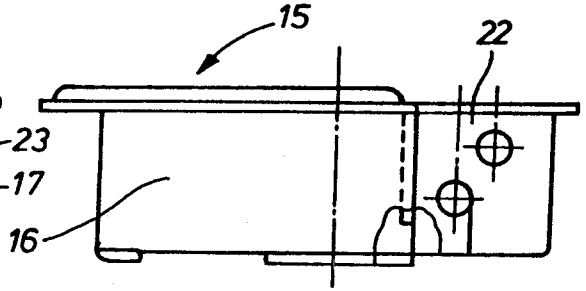
Figure 5:
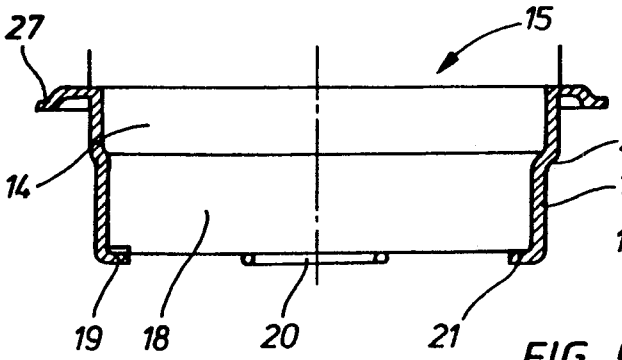
Figure 7:
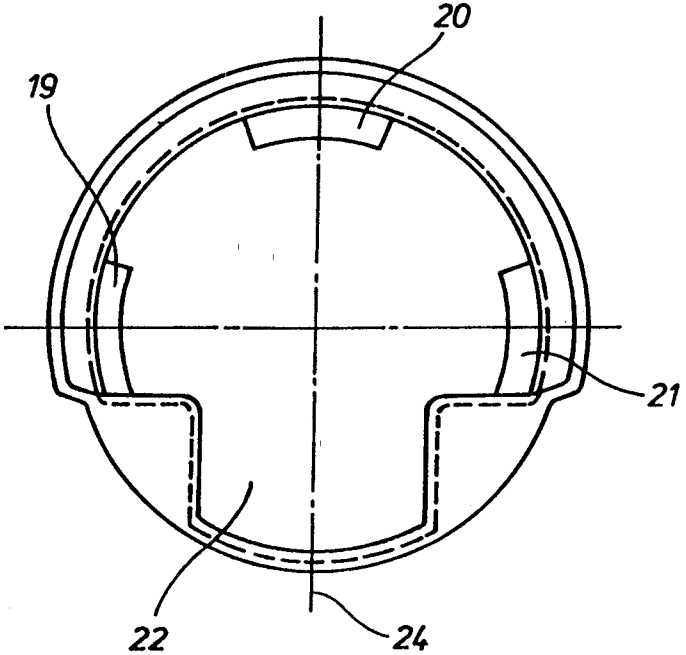

These show:

FIG. 1 : a hinge with rotary cup in the assembled state;

FIG. 2 : an alternative method, compared to FIG. 1, of anchoring the rotary cup in the door part;

FIG. 3 : a press-fit cup in section;

FIG. 4 : a plan view of the press-fit cup according to FIG. 3;

FIG. 5 : the rotary cup in section;

FIG. 6 : a side view of the rotary cup;

FIG. 7 : a plan view of the rotary cup.

According to FIG. 1 a hinge joint 31 is anchored in the body 32 via a quick-release fastening, wherein the hinge joint has a known type of pivot lever 30 through which it is pivotally connected to a hinge cup arranged in a door part 28.

Instead of the hinge joint 31 with two pivot levers as shown here, it is of course also possible to use other types of hinge joints, such as for example single-pivot hinge joints or hinge joints with corresponding adjusting devices for adjusting the height, sides and depth.

Essential in the present innovation is that the hinge cup arranged in the door part 28 has two parts and consists of a press-fit cup 1 inserted in the cup drilling 26 as well as a rotary cup 16 connected to the hinge joint 31 via the pivot lever 30.

In the FIGS. 3 and 4 the press-fit cup 10 has a cup-shaped housing 1 which forms a peripheral wall 2 in which are formed a number of anchoring lugs 3–6 spaced with respect to the upper edge 7 of the wall 2 around the circumference. In the embodiment example shown, four anchoring lugs 3–6 are evenly spaced around the circumference. It is obvious that a different number of anchoring lugs 3–6 can also be used. In the embodiment example shown, the anchoring lugs 3–6 are shaped with their points extending upwards, and in which there are a number of possibilities for anchoring these anchoring lugs 3–6 in the cup drilling 26.

In a first embodiment example (shown in FIG. 1 by full lines) the anchoring lugs 3–6 rest only in a force and form locking manner on the inside of the cup drilling 26, penetrating the material of the door part 28 when being bent (forced apart).

Another embodiment example in FIG. 1 is shown in broken lines and in FIG. 2 in full lines.

This shows that the anchoring lugs 3–6 when inserted in the press-fit cut 10 are bent towards the outside by a tool, enter the wall of the door part 28 and thus secure the press-fit cup 10 in the cup drilling 26.

The embodiment example in FIG. 4 shows that for making the bayonet connection between the press-fit cup 10 and the rotary cup 16, bent portions 11,12,13 are provided which, according to FIG. 3, are notched out of the bottom surface 9 of the housing 1 and constructed as portions 11–13 bent at right angles, parallel to the bottom surface 9 and extending radially outwards.

For manufacturing reasons it is preferred in this case if the anchoring lugs 3–6 are situated in the wall regions of the wall 2 of the housing 1 which are not covered by the bent portions 11–13.

The three bent portions 11–13 shown in FIG. 4 are to be taken as examples only. Any number of bent portions can be used. There may even be only one or two.

The rotary cup 15 shown in FIGS. 5 to 7 again shows merely a preferred example of the embodiment. This embodiment too can be altered within wide margins.

The lower part 18 of the housing 16 of the rotary cup 15 has a smaller diameter compared to that of the upper part 14, i.e. approximately the same internal diameter as the press-fit cup 10 to be received therein. The transition from a small to a large diameter in the wall 17 is effected in stages and may be in the form of a step 23.

In the assembled state, this step 23 can be seated on the top edge 7 of the housing 1 of the press-fit cup 10. However, the flange 27 of the cup edge of the rotary cup 15 also may rest on the surface of the door part 28.

As shown especially in FIG. 7, the bottom of the housing 16 has lugs 19–21 which are designed for engagement by the web-like bent portions 11–13 of the press-fit cup 10.

The arrangement of these lugs 19–21 on the periphery of the housing 16 is similar to the arrangement of the bent portions 11–13 in the press-fit cup 10. As is common with hinge cups, the rotary cup 15 according to FIG. 7 is radially outwardly enlarged in the direction of the pivot levers 30 (position 22) in order to permit the pivot levers 30 to swivel into the hinge cup when the door part is closed.

Accordingly, the lugs 19–21 are so arranged as to permit an even load to be inserted via the rotary cup 15 into the press-fit cup 10 relative to the longitudinal axis 24.

The arrangement of the press-fit cup 10 and the rotary cup 15 as shown makes it possible now to anchor in the cup drilling 26 of the door part 28 the press-fit cup 10 according to the different methods described above in order to then transport the door part 28 to the place of assembly as a separately stackable part.

During assembly the hinge joint 31 is initially released from the body 32 and the rotary cup 15, displaced an angle of rotation, is inserted in the press-fit cup 10 in such a way that the lugs 19–21 initially come to rest in the gaps between the bent portions 11–13 of the press-fit cup 10. The rotary cup 15 is then twisted so that the lugs 19–21 of the rotary cup 15 rest in a force and form-fitting manner against the lower sides of the bent portions 11–13 of the press-fit cup 10. The rotary cup 15 is thus anchored in the press-fit cup 10 in a secure and load transferring manner. At the end of this rapid assembly the hinge joint 31, via the quick-assembly fastening shown in FIG. 1, is pushed diagonally into the associated holders which are inserted in the body 32.

I claim:

1. In a hinge connecting a door with a supporting frame having a rotary cup with a circumferential wall and a press-fit cup with a floor arranged in the door in which, for assembly, the rotary cup is inserted into the press-fit cup positioned within a cup drilling on the door and, for fastening, is circularly twisted within and with respect to the press-fit cup wherein the press-fit cup has laterally rising walls of a selected height so that the press-fit cup is countersunk in the cup drilling of the door, anchoring lugs spaced from the floor and extending from the press-fit cup walls forcibly engaging and locking against the walls of the cup drilling, and press-fit cup bent portions extending upwardly and radially outwardly from the press-fit cup floor to free ends, said free ends being spaced from said rising walls: and the rotary cup has corresponding lugs extending radially inwardly from the rotary cup wall which are cooperatively received under the press-fit cup bent portions.

2. A hinge according to claim 1 wherein the rotary cup has an external flange which rests on the edge of the cup drilling on the door.

3. A hinge according to claim 1 wherein the lugs of the rotary cup are tilted.

4. A hinge according to claim 3 wherein anchoring lugs of the press-fit cup are bent radially outward and engage the material of the door in the inside region of the cup drilling.

* * * * *